US005517175A

United States Patent [19]

Brown et al.

[11] Patent Number: 5,517,175

[45] Date of Patent: May 14, 1996

[54] POTENTIAL ADJUSTING SENSOR SUPERVISION CIRCUIT

[75] Inventors: Glenn A. Brown, Gilroy; Robert B. Weinhold, San Francisco, both of Calif.

[73] Assignee: Stellar Security Products, Inc., Santa Clara, Calif.

[21] Appl. No.: 83,008

[22] Filed: Jun. 24, 1993

[51] Int. Cl.[6] ..... G08B 29/08

[52] U.S. Cl. ..... 340/511; 340/506; 340/870.21; 340/510; 364/138; 364/185

[58] Field of Search ..... 340/510, 511, 340/870.21, 506; 364/138, 184, 185

[56] References Cited

U.S. PATENT DOCUMENTS

| | | | |
|---|---|---|---|
| 4,287,515 | 9/1981 | Raber et al. | 340/510 |
| 4,567,471 | 1/1986 | Acar | 340/510 |
| 5,084,696 | 1/1992 | Guscott et al. | 740/511 |
| 5,155,468 | 10/1992 | Stanley et al. | 340/511 |

*Primary Examiner*—Brent A. Swarthout
*Assistant Examiner*—Daniel J. Wu
*Attorney, Agent, or Firm*—Weil, Gotshal & Manges

[57] ABSTRACT

A warning or alarm sensor supervision circuit employs varying voltage levels which may vary at random intervals and to random levels.

8 Claims, 3 Drawing Sheets

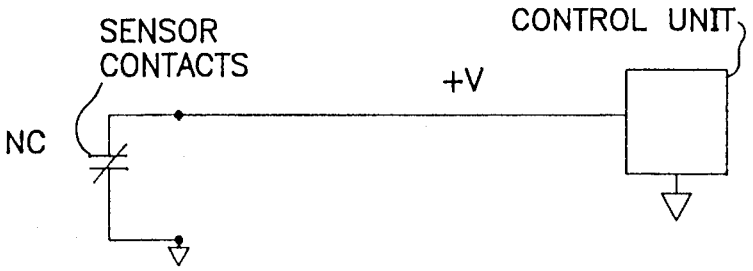
FIG. IA
(PRIOR ART)
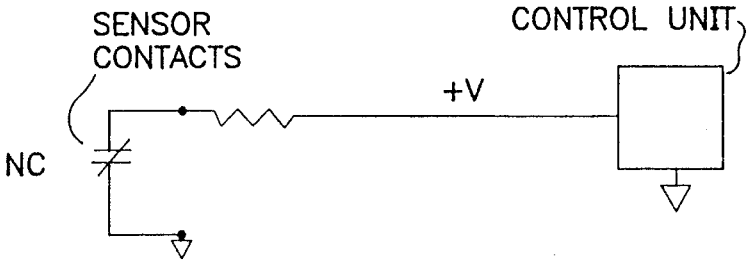
FIG. IB
(PRIOR ART)
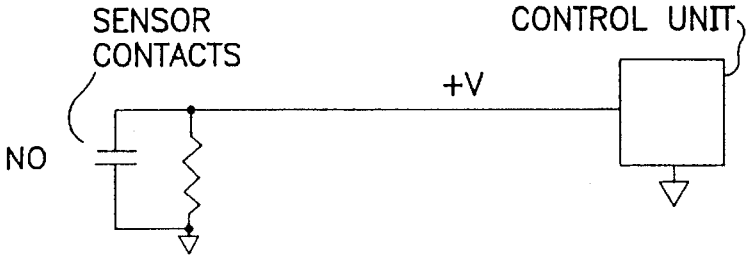
FIG. IC
(PRIOR ART)
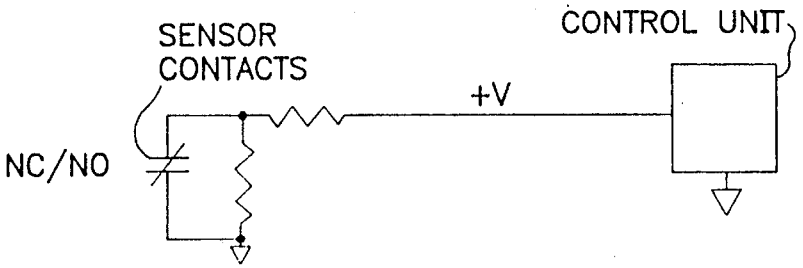
FIG. ID
(PRIOR ART)

POTENTIAL ADJUSTING SENSOR SUPERVISION CIRCUIT

BACKGROUND OF THE INVENTION

1. Field of The Invention

The present invention relates to alarm systems in general and, in particular to supervision circuits in a signalling, warning, or alarm system that extend between a sensor and a signalling control unit, warning control unit, or alarm control unit.

2. Background Information

Supervision circuits in such systems generally provide some capability to detect a circuit fault, and/or an attempt to defeat the circuit by manipulation of the wiring. Three forms of supervision are typically provided and will now be briefly summarized with reference to FIGS. 1A to 1D.

In a first form of supervision shown in FIG. 1A, a voltage is generated by a control unit and routed through normally closed switch contacts inside a sensor. Should the sensor be activated, i.e., "alarm" the normally closed switch contacts open, signalling an alarm condition to the control unit by a change in the current flowing therethrough. Should the supervision wiring be cut (opened), accidentally or intentionally, the control unit will also detect a change in the current flowing in the supervision circuit and signal an alarm.

This first method of supervision, however, provides no protection against compromise by someone shorting the supervision circuit wiring and effectively bypassing the sensor and cannot distinguish between a fault, "an alarm," and an intentional tampering condition.

In a second form of supervision shown in FIGS. 1B and 1C, a voltage is generated by a control unit and a current routed through a resistor located at the sensor in series or in parallel with the sensor contacts. For normally closed type sensor contacts as in FIG. 1B, this resistor is placed in series with the contacts. For normally open type sensor contacts as in FIG. 1C, the resistor is placed in parallel with the contacts. The control unit monitors the voltage and current in the supervision circuit. Activation of the sensor contacts either opens (FIG. 1B) or shorts (FIG. 1C) the supervision circuit, and this is detected at the control unit which signals an alarm. Should the supervision wiring between the control unit and the sensor be cut (opened) or jumpered (shorted) accidentally or intentionally, the control unit will detect a change in voltage and/or current and signal an alarm.

In a third form of supervision as shown in FIG. 1D, a voltage is generated by a control unit and a current routed through two resistors located at the sensor. One resistor is placed in series with the sensor contacts, and the other resistor is placed in parallel with them. Thus, regardless of the state of the sensor contacts, i.e., opened or closed, the voltage seen at the control unit will be greater than the lowest possible level, e.g., in a shorted condition, and less than the greatest possible value, e.g., in an open condition. Should the supervision wiring be cut (opened) or jumpered (shorted), accidentally or intentionally, the control unit will see the voltage change to its highest level or lowest level, respectively. In this way, the control unit can distinguish between alarm conditions generated by the sensor and trouble conditions with the supervision circuit.

This third method of supervision provides protection against compromise by jumpering or cutting, but it can still be defeated with relatively simple equipment and knowledge of the circuit. Insertion into the circuit of a regulated voltage source, for example, which can provide an appropriate voltage to the control unit, allows for removing and defeating the sensor circuit after attachment of the voltage source. Once the sensor has been removed, the protected area is of course vulnerable. A need has existed for a supervision method and/or circuitry which overcomes this vulnerability in existing systems.

The present invention was developed to overcome the limitations and thereby protect the existing circuits against such a threat without necessitating removal of existing resistive sensor devices which might already be installed, and which it might not be desirable to replace in the process of enhancing the supervision circuitry.

SUMMARY OF THE INVENTION

It is, therefore, a primary object of the present invention to provide an improved system for supervising the wiring and sensors associated with a microprocessor based security system, i.e., a signalling, warning, or alarm system. This is accomplished by the invention in which a voltage supplied to the supervision circuits of the security system by a control unit is varied, preferably at random intervals.

The embodiments according to the invention may employ several advantageous components/sub-systems. These may include control logic in the control unit to vary the supervision voltage as an integral part of the control unit. Alternately, a separate sub-control unit to vary the supervision voltage may be interconnected with the control unit. Or, a completely independent system can be provided to vary the supervision voltage without an associated control unit.

Analog to Digital Converter (ADC) circuitry for converting voltages returned from the sensors of the supervision circuits into digital form is provided. Circuitry is provided that varies the voltage to the supervision circuit and to the ADC voltage reference input, on command from the control unit in an embodiment of the invention. By way of example, but not limitation, this circuit might vary the voltage between 5.0 Vdc and 3.3 Vdc. The number of voltages to select from is not limited to two (2), but may have some practical limitations with respect to the resolution of the ADC and the number of control lines available from the control unit circuitry. The ADC may establish a digital output value between 0 and 256 in an embodiment which uses an 8 bit converter, the digital output value representing the analog voltage present at its input with respect to a low reference voltage (ground) and a high reference voltage, i.e., the reference voltage supplied by the control unit. Therefore, changing the reference voltage at both the ADC and the supervision circuit, will cause no change in the digital output value representing the voltage present on the input, since the relative voltage of the input with respect to the reference voltage remains the same.

Timer circuitry and/or a random number generator may be provided in another embodiment, wherein this circuitry and/or generator determines what the next reference voltage will be, and over what span of time it will remain at this value, before changing to another value. By way of example, but not limitation, this circuit could be implemented by a microprocessor employing a random number generator routine.

In another embodiment, averaging circuitry or a microprocessor performed routine to correct for variations in the ADC readings resulting from changes in the reference voltage due to, for example, line capacitance and ADC settling time, may be employed. The averaging circuit or routine samples the ADC readings in real-time, and then averages the collected samples. This circuit or routine does not need to stop or delay the sampling to allow for a settling period, and therefore provides robust supervision since the sampling process is never halted.

According to one embodiment, in a microprocessor based security system, having a control unit including the microprocessor, and at least one supervision circuit including at least one alarm sensor, such an arrangement includes first means for providing a reference voltage signal to the at least one supervision circuit. Second means is provided for receiving the reference voltage signal from the first means, for receiving an input voltage signal from the at least one supervision circuit, and for producing a voltage sample signal. The input voltage signal and the voltage sample signal are dependent on the reference voltage signal and are dependent on the state of the at least one supervision circuit. Evaluating means is provided for analyzing and classifying the voltage sample signal into one of ALARM, TAMPER and SECURE categories based on predetermined criteria. Advantageously, the first means includes voltage variation means for varying the reference voltage signal under the control of the control unit.

According to a further embodiment, the second means includes analog to digital converter means for receiving as an analog input signal the input voltage signal from the at least one supervision circuit, converting the analog input signal into a digital output signal dependent on the reference voltage signal, and providing the digital output signal as the voltage sample signal.

In another embodiment, the control unit produces at least one voltage varying signal, and the voltage variation means of the first means includes a voltage regulator for providing a regulated voltage, voltage divider means, including a plurality of resistors and at least one diode, for receiving the regulated voltage and the at least one voltage varying signal, and for providing a control voltage based thereon at an output thereof, and an operational amplifier for receiving the control voltage at an input thereof, and for providing the reference voltage to the second means and to the at least one supervision circuit at an output thereof.

In another embodiment, the control unit includes third means for controlling the producing of the at least one voltage varying signal, the third means employing random number generation for selecting a level and duration for the at least one voltage varying signal. In this way, the reference voltage signal and a duration period thereof are randomly varied by the control unit.

In another embodiment, the second means includes analog to digital converter means for receiving as an analog input signal the input voltage signal from the at least one supervision circuit, converting the analog input signal into a digital output signal dependent on the reference voltage signal, and providing the digital output signal as the voltage sample signal.

And in another embodiment, the at least one supervision circuit includes a sensor input buffering unit receiving the reference voltage signal from the first means, the sensor input buffering unit providing across a capacitor at a first output thereof the input voltage signal to the second means as a function of a current flowing through lines to the sensor, and providing at a second output thereof a supervision voltage proportional to the reference voltage signal from the first means, and a sensor unit including the at least one alarm sensor and a respective resistor network through which at least a portion of a current to the sensor unit flows, the current flowing through the sensor unit being dependent on the received supervision voltage from the sensor input buffering unit and the state of contacts of the alarm sensor, wherein the input voltage signal provided to the second means by the sensor input buffering unit is dependent on the current flowing through the lines to the sensor unit and the reference voltage signal from the first means.

Other objects and advantages will become apparent from the detailed description taken with the accompanying drawings.

BRIEF DESCRIPTION OF THE DRAWINGS

FIGS. 1A to 1D show conventional supervision systems;

DETAILED DESCRIPTION OF THE PREFERRED EMBODIMENTS

Figure 2:
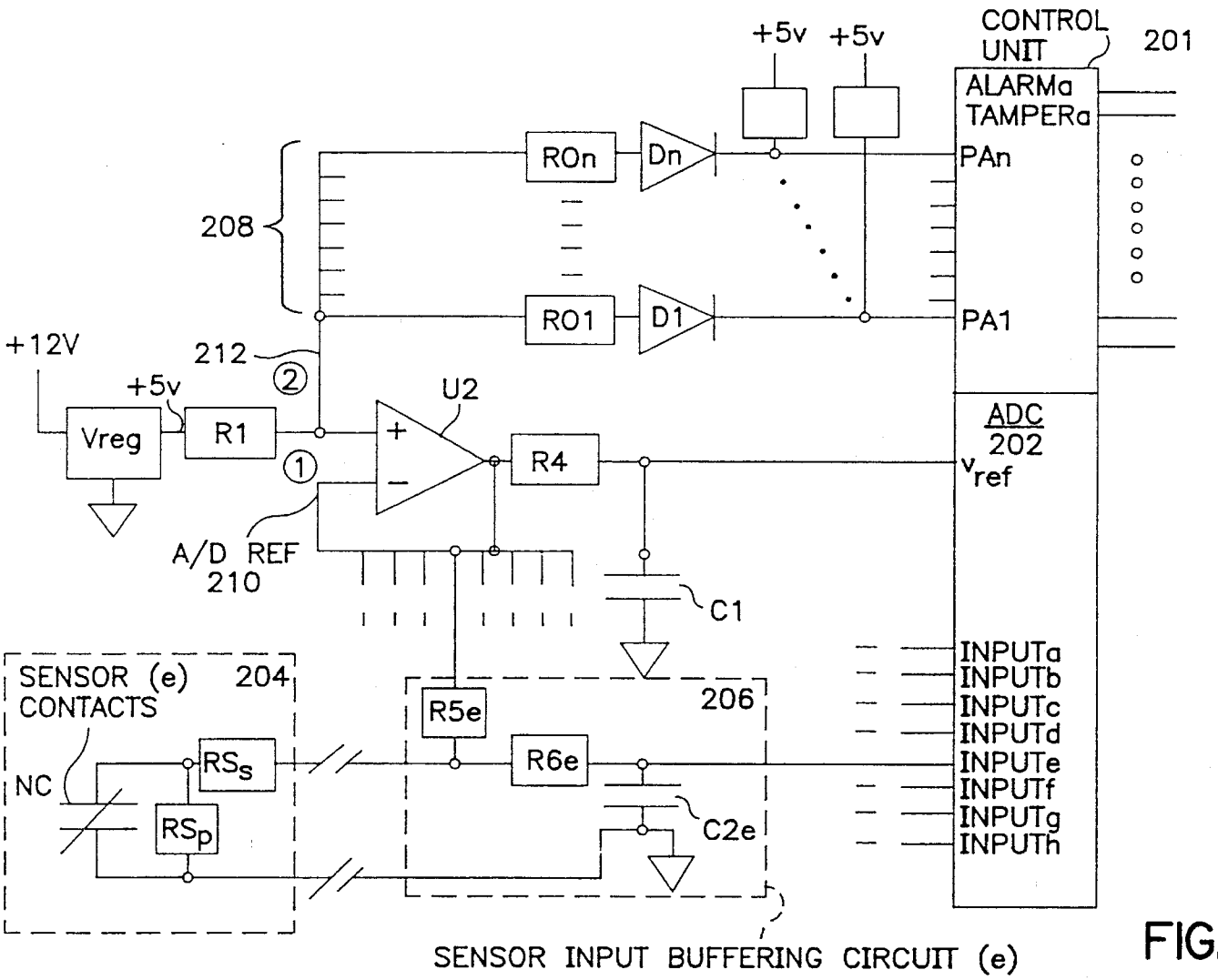
FIG. 2 is a block diagram schematic illustration of an embodiment of the invention.

Referring now to FIG. 2, shown is a control unit 201 with an eight input Analog-to-Digital Convertor (ADC) 202 supplied with an appropriate reference voltage (Vref) and eight input signals (INPUTa–h) in this embodiment. Each input signal (INPUTa–h) comes from a respective supervision circuit comprising a sensor circuit 204 and a respective input buffering circuit 206. Only one of the supervision circuits, sensor/sensor input circuit pair 204/206, is shown for ease of illustration.

A voltage regulator (Vreg) establishes a +5 V reference voltage which is supplied to Op-Amp U2 through resistor R1. The output of Op-Amp U2 is supplied through resistor R4 to the reference voltage input (Vref) of the ADC 202, and is fed back, as A/D REF 210, to the inverting input of amplifier U2. This voltage is also fed through a respective resistor to each of the sensor input buffering circuits 206, as shown in the figure through resistor R5e to the illustrated supervision circuit, to establish a supervision voltage.

R4 and C1 serve as a low-pass filter to decouple transients from the A/D reference voltage 210 to ground. The time constant of R4 and C1, must be matched as closely as possible to the R5e, RSs, Rsp, R6e and C2e network to minimize deviation on the controlled potential adjustments generated by the control unit through U2.

For example, passing only deviations occurring below 1 KHz would require the following calculation to ascertain the appropriate values of the circuit components.

- $C1$ and $C2$ are .047 $uf$ capacitors by selection.
- $R5$ and $RSs$ are 5.1 $K\Omega$ by selection.
- $RSp$ = 0 since the sensor contacts are normally closed in parallel with $Rsp$.
- $R6 = \frac{1}{2\pi FC} - \frac{1}{(1/R5 + 1/RSs)}$ Where $F = 1K$ and $C = .047 \times 10^{-6}$
  $R5 = 5{,}1000$, $RSs = 5{,}100$ $R6 = 836\ \Omega$
- $R4 = \frac{1}{2\pi FC}$ $R4 = 3.3\ K\Omega$ A typical supervision circuit includes a sensor 204 with dry contact relay outputs and may be configured with normally closed (NC) sensor contacts and series ($RS_s$) and parallel ($RS_p$) resistors, as is illustrated. The sensor input buffering circuit 206 serves to establish the supervision voltage on the sensor wire pair using the A/D ref voltage 210 coupled through resistor R5e, and also functions to buffer and filter, through resistor R6e and capacitor C2e, the input signal (INPUTe) to the ADC circuit 202. Significantly, because the reference voltage supplied to the ADC (A/D ref) from the output of Op-Amp U2 is also supplied to the supervision circuit 206/204, the input signal (INPUTe) from the supervision circuit will track any change in the ADC reference voltage. Changes in the voltage at INPUTe, i.e., signals at INPUTe, which represent an alarm or a tamper condition can be detected even if the A/D reference voltage, supplied to both the ADC Vref input and to establish the supervision voltage, is varied. To achieve the invention's objectives, this A/D reference voltage is varied in a controlled fashion, thereby likewise varying the supervision voltage to the sensors, making the alarm system less vulnerable to defeat as previously described.

For the purpose of varying the reference voltage, a +V voltage varying circuit 208 is provided. The circuit 208 receives voltages at multiple inputs from the control unit 201 output lines (PA1–PAn). The resistor divider networks (ROn, R3n) serve to combine the output lines to establish various voltages at the output of circuit 208 on line 212. Thus, the voltage at the output of circuit 208 is dependent on the outputs (PA1–n) from the control unit. The +5 v from the voltage regulator (Vreg) through resistor R1, and the voltage established by the control unit 201 with the voltage varying circuit 208 on line 212, are combined at the non-inverting input of Op-Amp U2. By varying the voltage on line 212 at the non-inverting input of Op-Amp U2, the Op-Amp output voltage can be varied which, as described above, is supplied to the ADC Vref input and to the sensor buffering circuit 206e to establish the supervision voltage.

As mentioned above, the supervisory circuit is supplied with the voltage from the output of Op-Amp U2 through resistor R5e at point 1 (circled). This in turn supplies the supervision voltage to the sensor unit 204 and sensor contacts. In the illustrated embodiment this voltage is varied through varying the voltage at the non-inverting input of Op-Amp U2. Op-Amp U2 is supplied with a +5 Vdc reference from the voltage regulator Vreg. This regulated voltage is an independent stable voltage, not used by other digital functions of the control logic of the system. This +5 Vdc reference is also fed to the R1, RO1–n, D1–n voltage divider network. The voltage present at point 2 (circled) is controlled by the state of the outputs from the control unit at PA1–n as follows.

If the control logic output on the lines PA1–n, for example, is high (+5 Vdc), resistors R31–n pull the cathodes of D1–n to +5 Vdc thus stopping the flow of current through resistors RO1–n and diodes D1–n. The non-inverting input of Op-Amp U2 (point 2) is then at +5 Vdc volts and the Op-Amp U2 will transfer this voltage to its output, and in turn, through resistor R4 to the ADC reference voltage input (Vref) and to the sensor input buffering circuit 206. When the control unit subsequently varies the voltage, it drives, for example, the outputs on lines PA1–n low and causes R1 and resistors RO1–n through diodes D1–n to act as voltage dividers. The voltage appearing at the non-inverting input of Op-Amp U2, and therefore at its output, is thereby changed due to the voltage drop across resistor R1.

By varying the outputs on the lines PA1–n of the control unit 201, the voltage at the Op-Amp non-inverting input can be thus varied accordingly. The voltage divider portions established with resistors R3n and ROn can be configured so that the value of ROn is different than R3n to thereby provide the capability of establishing a desired different voltage at point 2 (circled). The number (n) of outputs (PA) and voltage divider portions (RO, R3) can be as many as desired, and is only limited based on the outputs available from the control unit 201 and the resolution of the ADC 202. Therefore, a variety of voltages can be produced and applied to both the ADC reference voltage input Vref as well as to the supervision circuit sensor input buffering circuit 206.

Figure 3:
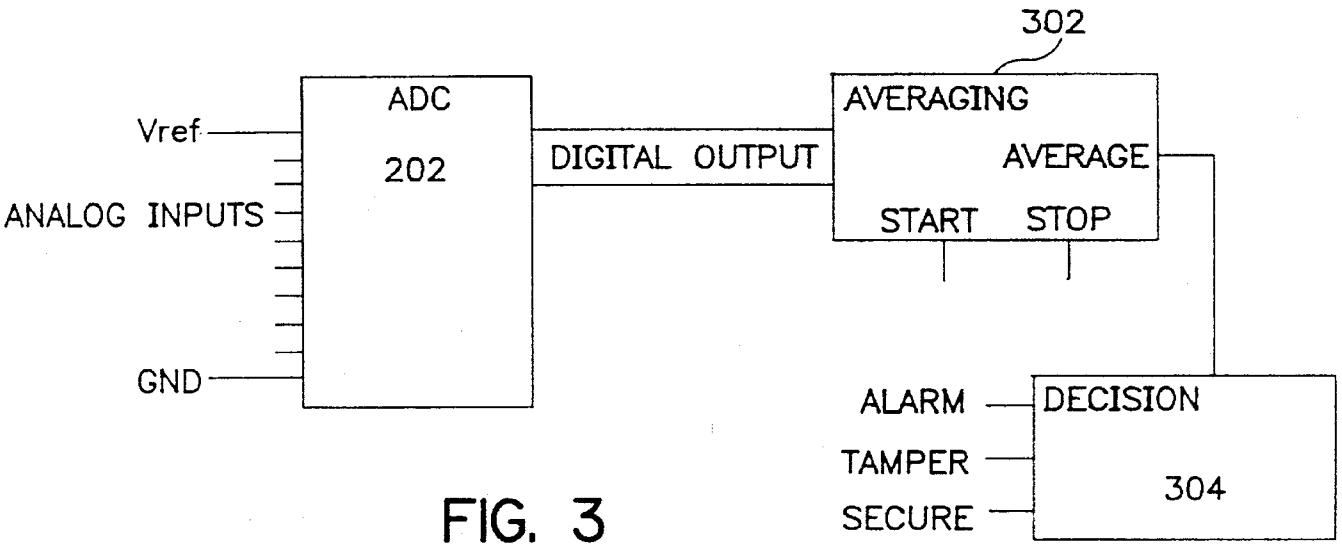
FIG. 3 is a functional block diagram showing how alarm, tamper and secure decisions are made.

FIG. 3 shows a functional block diagram of how a decision regarding an Alarm, Tamper or Secure Condition would be determined in the control unit 201. An analog input signal is received at an input of the ADC 202, and a digital output is produced. The digital output is passed to an averaging functional block 302 where an average value is computed based on the present output and a number of previous digital outputs from the ADC 202. The START line indicates that the averaging block 302 starts with some first digital output and the STOP line indicates the averaging block 302 stops with some last digital output, the average being computed on the digital outputs received from the ADC 202 between the START and STOP times.

Averaging of a number of digital outputs from the ADC 202 may be necessary, for example, in order to avoid false alarm situations. For example, ambient electrical noise, caused by local electrical equipment and the like, can induce a voltage spike on the sensor lines which could be misinterpreted as a tamper condition. Also, because the voltage on the sensor lines is being changed from time to time under the control of the control unit 201, and because the sensor lines have electrical characteristics, e.g., line capacitance, different from the ADC Vref input line, a change in the sensor line voltage may lead or lag a corresponding change in the reference voltage to the ADC, leading to variations in the ADC readings. In this situation, some short time period must be allowed for the ADC input voltages to "settle" before the supervision circuit voltage at the ADC input is considered to indicate an abnormal condition.

The output of the averaging functional block 302 is an average value which is passed to a decision functional block 304 for determining whether an alarm, tamper or secure condition is present, depending on the value of the average signal from the averaging functional block 302. Upon making the decision, decision functional block 304 output either an ALARM, a TAMPER or a SECURE signal to the rest of the system which will react in an appropriate manner, by sounding an alarm signal, for example, if TAMPER or ALARM are indicated.

Referring again to FIG. 3, the averaging functional block 302 and decision block 304 may consist of hardware and/or software. In the preferred embodiment, a microprocessor operating in the control unit 201 is programmed to perform the averaging 302 and decision 304 functions, as well as controlling the varying of the supervision voltage, the reading of the ADC 202, sounding the alarm, etc.

In this embodiment, the microprocessor could execute the following routine, for example, in order to perform the averaging and decision functions to correct for variations in the ADC 202 readings:

---

Begin Averaging Routine
Clear Alarm, Tamper, and Reads Counters
Do Loop

-continued

```
    Increment Reads Counter
    Read ADC (values will be between 0 and 256)
        If ADC Value (>134 and <162) or (>94 and <122)
            Increment Alarm Counter
        If Value (>162 or <94)
            Increment Tamper Counter
Loop for 1/10th second
Check which Case
    Case Alarm Counter > Half Reads
            Indicate Alarm
    Case Tamper Counter > Half Reads
        Indicate Tamper
    Otherwise
            Indicate Secure
End Averaging Routine
```

By way of example, but not limitation, the averaging routine could be implemented to gather the maximum number of ADC conversions possible within, for example, a 0.1 second interval, and if more than fifty percent of these samples indicates that the sensor has alarmed, the routine will signal an alarm. However, if more than fifty percent of the samples indicate that the supervision circuit has been tampered with, the routine will signal a tamper condition. If neither an alarm nor a tamper is detected, then the routine will signal a secure condition.

Figure 4:
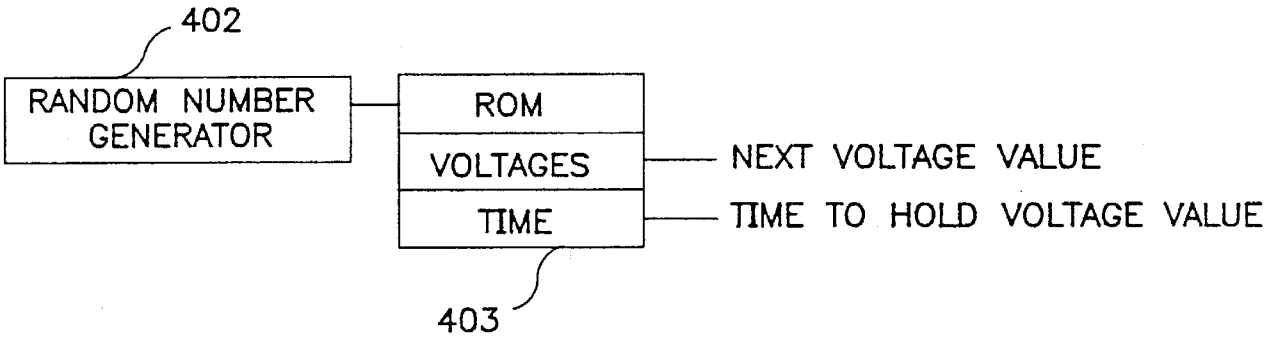
FIG. 4 is a block diagram showing a random number generator aspect of the invention.

The control unit 201 may control the supervision voltage so that is takes on a periodic form, or it may be controlled to be random. In the latter case, as depicted in FIG. 4, a random number generator block 402 produces random numbers which are used to address a read only memory (ROM) 403 and access a stored voltage to use as a next voltage value and a stored time to use as the length of time to hold the voltage value, for example. Alternatively, these voltage and time values may be calculated directly by the microprocessor using a random number as a base. Using a random variation in the supervision voltage protects against the sophisticated tamperer who may monitor the supervision voltage, detect a repetitive periodic pattern, and provide a voltage source to imitate it.

The random number function could be programmed to select a random period of time between 0.1 and 1.6 seconds, in increments of 0.1 seconds, as the time period during which the reference voltage would remain at, for example, either 5.0 Vdc or 3.3 Vdc before changing. Further, a new voltage could be selected using a second random number generator function which would point to the new value. This new value could reselect the present value for another random period, or select some new value.

It will be understood that the above description of the preferred embodiment of the present invention is susceptible to various modifications, changes, and adaptations, and the same are intended to be comprehended within the meaning and range of equivalents of the appended claims.

It will be apparent to one of ordinary skill in the art that the manner of making and using the claimed invention has been adequately disclosed in the above-written description of the preferred embodiment taken together with the drawings.

What is claimed is:

1. In a microprocessor based security system, having a control unit including the microprocessor, and at least one supervision circuit including at least one alarm sensor, an arrangement comprising:

first means for providing a reference voltage signal to the at least one supervision circuit;

second means for receiving the reference voltage signal from the first means, for receiving an input voltage signal from the at least one supervision circuit, and for producing a voltage sample signal, the input voltage signal and the voltage sample signal being dependent on the reference voltage signal and being dependent on the state of the at least one supervision circuit; and evaluating means for analyzing and classifying the voltage sample signal into one of ALARM, TAMPER and SECURE categories based on predetermined criteria;

wherein said first means includes voltage variation means for varying the reference voltage signal under the control of the control unit.

2. The arrangement according to claim 1, wherein the second means comprises analog to digital converter means for receiving as an analog input signal the input voltage signal from the at least one supervision circuit, converting the analog input signal into a digital output signal dependent on the reference voltage signal, and providing the digital output signal as the voltage sample signal.

3. The arrangement according to claim 1, wherein the control unit produces at least one voltage varying signal, and wherein the voltage variation means of the first means comprises:

a voltage regulator for providing a regulated voltage;

voltage divider means, including a plurality of resistors and at least one diode, for receiving the regulated voltage and the at least one voltage varying signal, and for providing a control voltage based thereon at an output thereof; and an operational amplifier for receiving the control voltage at an input thereof, and for providing the reference voltage to the second means and to the at least one supervision circuit at an output thereof.

4. The arrangement according to claim 3, wherein the control unit comprises third means for controlling the producing of the at least one voltage varying signal, the third means employing random number generation for selecting a level and duration for the at least one voltage varying signal, whereby the reference voltage signal and a duration period thereof are randomly varied by the control unit.

5. The arrangement according to claim 4, wherein the second means comprises analog to digital converter means for receiving as an analog input signal the input voltage signal from the at least one supervision circuit, converting the analog input signal into a digital output signal dependent on the reference voltage signal, and providing the digital output signal as the voltage sample signal.

6. The arrangement according to claim 1, wherein the at least one supervision circuit comprises:

a sensor input buffering unit receiving the reference voltage signal from the first means, the sensor input buffering unit providing across a capacitor at a first output thereof the input voltage signal to the second means as a function of a current flowing through lines to the sensor, and providing at a second output thereof a supervision voltage proportional to the reference voltage signal from the first means; and a sensor unit comprising the at least one alarm sensor and a respective resistor network through which at least a portion of a current to the sensor unit flows, the current flowing through the sensor unit being dependent on the received supervision voltage from the sensor input buffering unit and the state of contacts of the alarm sensor;

wherein the input voltage signal provided to the second means by the sensor input buffering unit is dependent on the current flowing through the lines to the sensor unit and the reference voltage signal from the first means.

7. In a microprocessor based security system, having a control unit including the microprocessor, at least one supervision circuit including at least one alarm sensor, and an analog to digital converter, a method comprising:

providing a reference voltage signal to the at least one supervision circuit, the reference voltage signal being varied under the control of the control unit;

receiving the reference voltage signal, receiving an input voltage signal from the at least one supervision circuit, and producing a voltage sample signal, with the analog to digital converter, the input voltage signal and the voltage sample signal being dependent on the reference voltage signal and being dependent on the state of the at least one supervision circuit; and analyzing and classifying the voltage sample signal into one of ALARM, TAMPER and SECURE categories based on predetermined criteria.

8. The method according to claim 7, wherein the step of providing a reference voltage signal to the at least one supervision circuit, the reference voltage signal being varied under the control of the control unit, comprises:

generating a random number in the control unit; and using the random number to randomly vary a level and duration of the voltage reference signal.

* * * * *